United States Patent [19]

Kanemoto et al.

[11] Patent Number: 4,859,099

[45] Date of Patent: Aug. 22, 1989

[54] AUTOMATIC PAPER LOADING APPARATUS FOR PRINTER HAVING PAPER BAIL ACTUATING DEVICE

[75] Inventors: Seiichi Kanemoto, Nagoya; Mutsuo Fukuoka, Yokkaichi, both of Japan

[73] Assignee: Brother Kogyo Kabushiki Kaisha, Japan

[21] Appl. No.: 259,210

[22] Filed: Oct. 18, 1988

[30] Foreign Application Priority Data

Oct. 22, 1987 [JP] Japan ..... 62-267530
Mar. 14, 1988 [JP] Japan ..... 63-61337

[51] Int. Cl.[4] ..... B41J 13/36; B41J 13/20
[52] U.S. Cl. ..... 400/636.1; 400/639.1
[58] Field of Search ..... 400/639, 639.1, 639.2, 400/636.1, 320, 322, 582, 76

[56] References Cited

U.S. PATENT DOCUMENTS 4,437,780 3/1984 Weber et al. ..... 400/636.1 X
4,630,814 12/1986 Kawakubo et al. ..... 400/639.1 X
4,684,277 8/1987 Edstrom et al. ..... 400/639.1 X
4,707,159 11/1987 Hirano et al. ..... 400/639.1
4,714,364 12/1987 Takada ..... 400/639.1

*Primary Examiner*—Charles Pearson
*Attorney, Agent, or Firm*—Oliff & Berridge

[57] ABSTRACT

An apparatus for automatically loading a printer with a recording medium, having a medium feeding motor, a carriage with a print head, a medium guide pivotable between a first position for urging the medium against a medium support, and a second position away from the support, a release member actuated by the motor, for pivoting the guide to the second position, a clutch operable between an operated position for transmitting a motion of the motor to the release member, a non-operated position in which the motion is not transmitted to the release member, and an intermediate position, a switching device operable by a movement of the carriage to a loading standby position, for operating the clutch from the non-operated position to the intermediate position in which a movement of the carriage away from the loading standby position toward the printing area permits the clutch to return to the non-operated position unless the motor is activated, and a controller for controlling the medium loading operation, by moving the carriage to the loading standby position, and activating the motor so as to operate the clutch from the intermediate position to the operated position.

12 Claims, 13 Drawing Sheets

AUTOMATIC PAPER LOADING APPARATUS FOR PRINTER HAVING PAPER BAIL ACTUATING DEVICE

BACKGROUND OF THE INVENTION

1. Field of the Invention

The present invention relates generally to an apparatus for loading a printer with a recording medium, and more particularly to an automatic medium loading apparatus which incorporates a mechanism for operating a paper bail between operated and retracted positions.

2. Discussion of the Prior Art

In a printer, or a printing mechanism incorporated in a typewriter for example, a recording medium such as a cut sheet is supported by a suitable support member such as a platen, and a portion of the medium is held in place on the support member by a suitable medium guide member such as a paper bail, which prevents the leading portion of the medium from being lifted away from the support member. The medium support member is supported by a frame of the printer such that the support member extends parallel to a direction of movement of the printing mechanism (including a print head mounted on a carriage or carrier). The medium guide member has presser members and is pivotally supported by the printer frame such that the presser members are moved between a first or urging position for urging the recording medium against the medium support member, and a second or retracted position in which the presser members are spaced apart from the medium support member. Normally, the medium guide member is maintained in its first position by suitable holding or biasing means.

The recording medium suitably loaded on the printer or printing mechanism is automatically fed or advanced by a suitable distance at the end of printing each line on the medium. The printer incorporates a medium feeding mechanism which includes a medium feeding motor. This mechanism cooperates with the medium support and guide members to constitute a medium feeding and advancing device. This device may have an automatic medium loading function for automatically feeding and advancing the recording medium to a predetermined printing start position prior to starting the printing operation on the medium. When this automatic medium loading operation is accomplished, it is necessary to move the medium guide member to its second position, so that the leading end portion of the automatically advanced medium may pass between the medium support member and the medium guide member. In view of this requirement, a medium feeding and advancing device is proposed in laid-open Publication No. 61-197263 (published in 1986) of unexamined Japanese Patent Application No. 60-39462, wherein the medium feeding motor is utilized as a drive source for operating the medium guide member to its second position, upon automatic loading of the recording medium.

The feeding and advancing device disclosed in the above-identified publication includes: a release member which is driven by the medium feeding motor, to operate the medium guide member to the second position; a clutch which is operable between an operated position for transmitting the drive force of the motor to the release member and a non-operated position in which the motor drive force is not transmitted to the release member; and a clutch regulator for controlling the clutch in relation to the movement of the printing mechanism. The clutch regulator includes a switching device for normally holding the clutch in the non-operated position, and for switching the clutch to its operated position when the printing mechanism is moved to a predetermined medium loading standby position. The clutch regulator further includes a control device adapted to move the printing mechanism to the medium loading standby position, and then moving the printing mechanism to a suitable position such as a printing start position.

When the medium feeding motor is operated after the clutch is switched to the operated position with the printing mechanism moved to the medium loading standby position, the recording medium is fed by feed rollers, and at the same time the medium guide member is operated to the second position by the release member, whereby the presser rollers of the medium guide member are lifted to permit the passage of the recording medium between the medium support member and the presser rollers. When the printing mechanism is moved away from the medium loading standby position, the switching device is returned to a position for holding the clutch in the non-operated position. However, the clutch per se cannot be returned to the non-operated position until the release member is rotated by the medium feeding motor by a predetermined angle to enable the medium guide member to return to its first position.

In the medium feeding and advancing device described above, the movement of the printing mechanism to the medium loading standby position necessarily activates the clutch to its operated position. For the clutch to return to the non-operated position, the medium feeding motor should be operated by an amount necessary to load the printer with the recording medium. Therefore, the medium loading standby position should be located outside the printing area in which the printing mechanism is movable, in order to prevent the clutch from being moved to the operated position, except when the medium loading operation is effected. This means a relatively narrow printing area or a relatively large lateral size of the printer.

Even in the event that the printing mechanism is moved to the medium loading standby position by error, the medium feeding motor should be activated to effect a medium loading operation. This is troublesome, and unnecessarily advances the recording medium if it is already set on the printer. The unnecessarily advanced recording medium should be returned to the original position so that the printing is started at the intended position. This is also troublesome.

Some printers are adapted such that upon power application, the printing mechanism is once moved to a zeroing position beyond the printing area, to establish the zero point of the printing mechanism, so that the printing mechanism is moved to the commanded positions for a printing operation. The printing mechanism may also be zeroed after the top cover of the printer is opened and closed during a printing job, for replacing a ribbon cassette, for example. In such cases, the zeroing position should be spaced apart from the medium loading standby position in the direction toward the printing area, so as to prevent the clutch from being switched to the operated position when the printing mechanism is moved to the zeroing position. Thus, the printing mechanism should be moved to the two different positions for the zeroing operation and the medium loading operation. In a printer disclosed in U. S. Pat. No. 4,264,220, for example, the carriage is zeroed by activating a carriage feeding motor to move the carriage to a predetermined carriage zeroing position and further activating the motor in an out-of-synchronization manner without a displacement thereof, with the carriage held at the zeroing poisition by a suitable stop. In this type of printer, the carriage zeroing position is located at an extreme left or right position of the carriage travel, while the medium loading standby position is located at the other extreme position opposite to the carriage zeroing position. This means increased complexity of the control system for controlling the carriage movements for the carriage zeroing operation and the medium loading operation.

In the case where the carriage zeroing is effected solely based on a signal generated by a detector switch for detecting the zero point of the carriage, the switch should be positioned with extremely high accuracy, in order to precisely position the carriage at its zero point.

SUMMARY OF THE INVENTION

It is accordingly a first object of the present invention to provide an automatic medium loading apparatus for a printer, wherein the medium guide member is operated to the retracted or lifted position upon automatic medium loading operation, and which permits the movement of the printing mechanism to the medium loading standby position (for example, for establishing the zero-point of the carriage) without operating the medium guide member.

A second object of the invention is to provide such a medium loading apparatus which permits the printer to initiate or effect the medium loading operation and the zeroing of the printing mechanism at the same position, thereby increasing the printing area of the printer.

A third object of the invention is to provide such a medium loading apparatus wherein the printing mechanism having a second medium guide member is moved to a medium loading position in which the printer is loaded with the recording medium.

The above first and second objects may be achieved according to the principle of the present invention, which provides an apparatus for automatically loading a printer with a recording medium, comprising: a support member supported by a frame of the printer, for supporting the recording medium; a medium feeding mechanism having a medium feeding motor, for feeding the recording medium; a carriage having a print head mounted thereon and movable in a longitudinal direction of the support member, the carriage having a medium loading standby position; a medium guide member having a presser portion and pivotally supported by the frame such that the medium guide member is movable between a first position in which the presser portion urges the recording medium against the support member, and a second position in which the presser portion is spaced apart from the support member; holding means for holding the medium guide member in the first position; a release member actuated by the medium feeding motor, for pivoting the medium guide member to the second position; a clutch operable between an operated position for transmitting a motion of the medium feeding motor to the release member, a non-operated position in which the motion is not transmitted to the release member, and an intermediate position between the non-operated and operated positions; a switching device operable by a movement of the carriage to the medium loading standby position, for operating the clutch from the non-operated position to the intermediate position in which a movement of the carriage away from the medium loading standby position toward a printing area of the printer permits the clutch to return to the non-operated position unless the medium feeding motor is activated; and a control device for controlling an operation to load the printer with the recording medium, by moving the carriage to the medium loading standby position, and activating the medium feeding motor so as to operate the clutch from the intermediate position to the operated position.

In the automatic medium loading apparatus of the present invention constructed as described above, the mere movement of the carriage to the medium loading standby position will not cause the clutch to be moved to its operated position. In other words, the carriage may be moved to the medium loading standby position, for a purpose other than moving the presser portion of the medium guide member to the second position. Therefore, the medium loading standby position may be the same as the zeroing position of the carriage. Accordingly, the printing area or range of the printer can be increased without increasing the lateral size of the printer in the longitudinal direction of the medium support member. In addition, the control program for controlling the movements of the carriage for zeroing the carriage and loading the printer with the recording medium can be significantly simplified. Further, the medium loading standby position may be located within a range of movement of the carriage in which the printing is possible by the printing mechanism. In this case, the printing area can be further increased.

Further, the erroneous operation to move the carriage to the medium loading standby position will not trigger the medium feeding motor, i.e., will not cause an unnecessary operation of the feeding motor, which results in an undesirable and unnecessary feeding of the recording medium if already set on the printer and if so, requires the recording medium to be returned to the original position.

In one form of the present invention, the clutch comprises a partial gear which has a non-toothed portion and a toothed portion, and a complete gear which has teeth on an entire circumference thereof and which is engageable with the partial gear. In this arrangement, a rotary motion of the complete gear is not transmitted to the partial gear while the non-toothed portion of the partial gear faces the teeth of the complete gear, and is transmitted to the partial gear while the toothed portion of the partial gear engages the teeth of the complete gear.

According to one feature of the above form of the invention, the switching device comprises: a first elastic member for biasing the partial gear in one rotating direction; a stop which is rotated with the partial gear; a latch member including an engaging portion engageable with the stop, and operable to hold the clutch in the non-operated position in which the partial gear is maintained against a biasing force of the first elastic member, in a position in which the non-toothed portion faces the complete gear; a second elastic member for biasing the latch member in a direction that causes the engaging portion to engage the stop; and a latch release mechanism disposed between the latch member and the carriage, for moving the latch member away from the stop as the carriage is moved toward the medium loading standby position. The stop is inclined with respect to a direction of movement of the engaging portion of the latch member while the clutch is in the intermediate position in which a tooth of the partial gear which defines one end of the non-toothed portion is in engagement with one of the teeth of the complete gear under the biasing action of the first elastic member. A biasing force of the second elastic member is determined to be sufficient to rotate the partial gear against the biasing force of the first elastic member, in a direction that causes the tooth at the one end of the non-toothed portion to be disengaged from the one tooth of the complete gear, with the engaging portion of the latch member held in sliding contact with the stop, through an effect of a relative inclination between the stop and the direction of movement of the engaging portion. In this arrangement, the inclination of the stop to the path taken by the engaging portion of the latch member, and the provision of the third elastic member enable the clutch to be returned from the intermediate position to the non-operated position, if the carriage is moved toward the printing area after it is moved to the medium loading standby position. Thus, this arrangement permits the carriage to be zeroed at the medium loading standby position, without activating the clutch to the operated position or without moving the medium guide member to the second position.

According to the above feature of the invention, the apparatus may further comprise a sensor disposed adjacent to the latch member, for detecting a separation of the latch member from the stop. In this case, the movement of the latch member by the latch release mechanism upon movement of the carriage to the medium loading standby position is effectively utilized to detect the zero point of the carriage.

According to another feature of the same form of the invention, the support member comprises a platen rotatably supported by the frame, and a gear train through which the platen is driven by the medium feeding motor, the platen serving as a major element of the medium feeding mechanism, while the complete gear serving as one member of the gear train.

According to a further feature of the same form of the invention, the switching device comprises a first elastic member for biasing the partial gear toward a position thereof in which the non-toothed portion faces the complete gear, a second elastic member extending from the carriage, and engaging means engageable with the second elastic member and rotatable with the partial gear. A shape of the second elastic member is determined such that the second elastic member is brought into engagement with the engaging means as the carriage is moved toward the medium loading standby position, and is elastically deformed by the engaging means as the carriage is further moved, whereby the engaging means is biased in a direction that causes the partial gear to be rotated against a biasing force of the first elastic member, and the clutch is maintained in the intermediate position by the second elastic member. In this case, the engaging means may consist of a portion of the partial gear which defines a hole formed through a thickness thereof, and the second elastic member may consist of a sheet spring which is inserted in the hole and engages the portion of the partial gear defining the hole.

In another form of the present invention, the control device operates the medium feeding motor by an amount sufficient to cause the clutch to be moved to the operated position in which the toothed portion of the partial gear engages the complete gear after the carriage is moved to the medium loading standby position. The control device then operates the carriage away from the medium loading standby position, and operates the medium feeding motor by an amount necessary to feed the recording medium to a predetermined print start position.

In a further form of the invention, the medium guide member includes a paper bail shaft which extends parallel to the support member, a pair of levers having fixed end portions at which the levers are pivotally supported by the frame, and free end potions at which the levers support opposite ends of the paper bail shaft, and a plurality of presser rollers which are rotatably supported on the paper bail shaft and spaced apart from each other in an axial direction of the paper bail shaft.

The holding means may include at least one elastic member for biasing the medium guide member toward the first position. The release member may consist of a cam which rotates with the partial gear and which is engageable with a cam follower portion of the medium guide member to pivot the medium guide member to the second position thereof.

The third object of the invention indicated above may be attained according to another aspect of the present invention, which provides an apparatus for automatically loading a printer with a recording medium, comprising: a support member supported by a frame of the printer, for supporting the recording medium; a medium feeding mechanism having a medium feeding motor, for feeding the recording medium; a carriage having a print head and a first medium guide member mounted thereon and movable in a longitudinal direction of the support member, the carriage having a medium loading standby position; a second medium guide member having a presser portion and pivotally supported by the frame such that the second medium guide member is movable between a first position in which the presser portion urges the recording medium against the support member, and a second position in which the presser portion is spaced apart from the support member; holding means for holding the second medium guide member in the first position; a release member actuated by the medium feeding motor, for pivoting the second medium guide member to the second position; a clutch operable between an operated position for transmitting a motion of the medium feeding motor to the release member, a non-operated position in which the motion is not transmitted to the release member, and an intermediate position between the non-operated and operated positions; a switching device operable by a movement of the carriage to the medium loading standby position, for operating the clutch from the non-operated position to the intermediate position in which a movement of the carriage away from the medium loading standby position to a medium loading position permits the clutch to return to the non-operated position unless the medium feeding motor is activated; and a control device for controlling an operation to load the printer with the recording medium, by moving the carriage to the medium loading standby position, activating the medium feeding motor by an amount sufficient to cause the clutch to be moved to the operated position, moving the carriage from the medium loading standby position to the medium loading position, and then activating the medium feeding motor by an amount necessary to feed the recording medium to a predetermined print start position such that the medium is passed between the support member and the second medium guide member, while being guided by the first medium guide member.

In the apparatus constructed as described above, the carriage has the first guide member fixed thereto. The first guide member cooperates with the second guide member to guide the recording medium while the medium is fed during a printing operation. When the printer is loaded with the recording medium, the carriage once moved to the medium loading standby position is moved to the medium loading position such as a central position of the carriage travel, and then the medium feeding motor is activated at the medium loading position, whereby the recording medium fed by the motor can be guided by the first guide member, before the medium is passed between the support member and the first guide member placed in its second or retracted position.

BRIEF DESCRIPTION OF THE DRAWINGS

The above and optional objects, features and advantages of the present invention will be better understood by reading the following detailed description of presently preferred embodiments of the invention, when considered in conjunction with the accompanying drawings, in which:

FIG. 5 is a side elevational view also corresponding to that of FIG. 2, showing a state of the paper bail release mechanism in which an automatic paper loading operation is initiated;

DETAILED DESCRIPTION OF THE PREFERRED EMBODIMENTS

Figure 1:
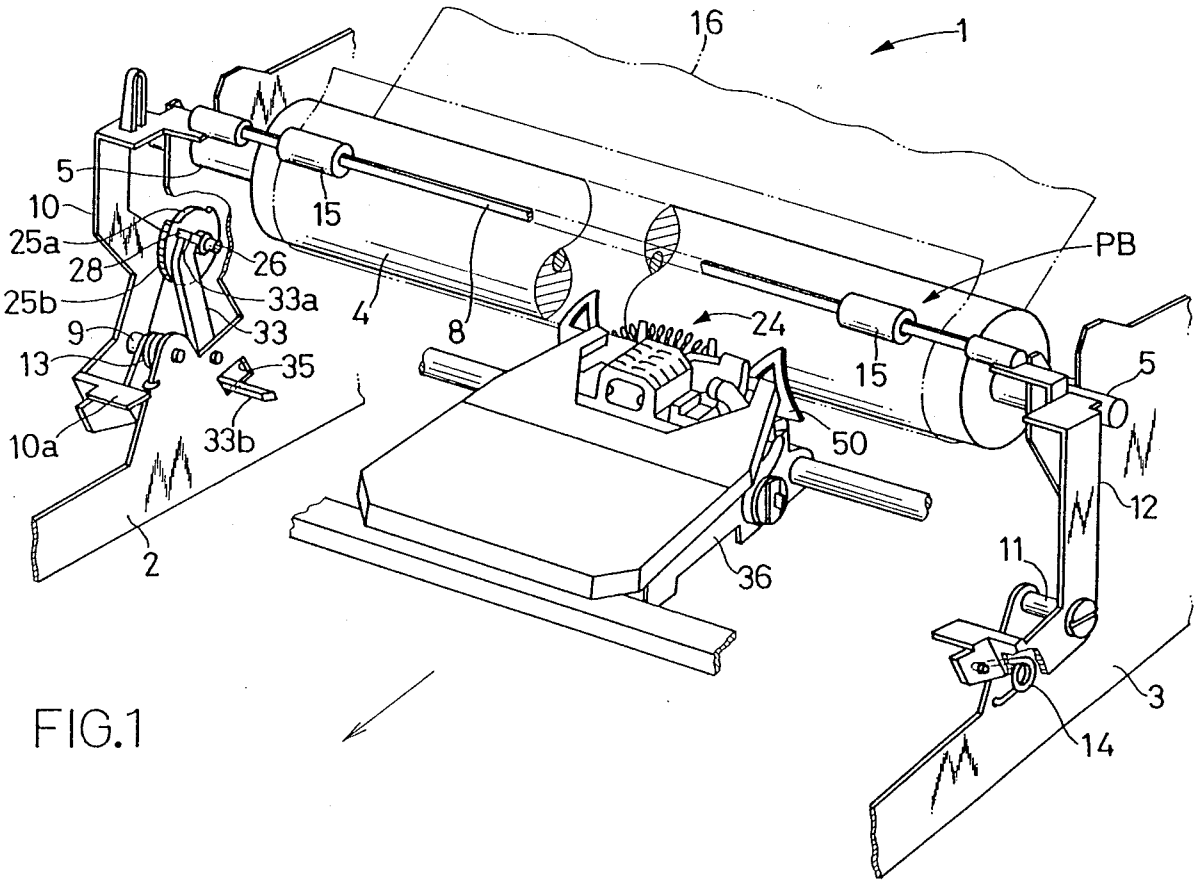
FIG. 1 is a schematic perspective view of a typewriter equipped with one embodiment of an automatic paper loading apparatus of the present invention.
Figure 2:
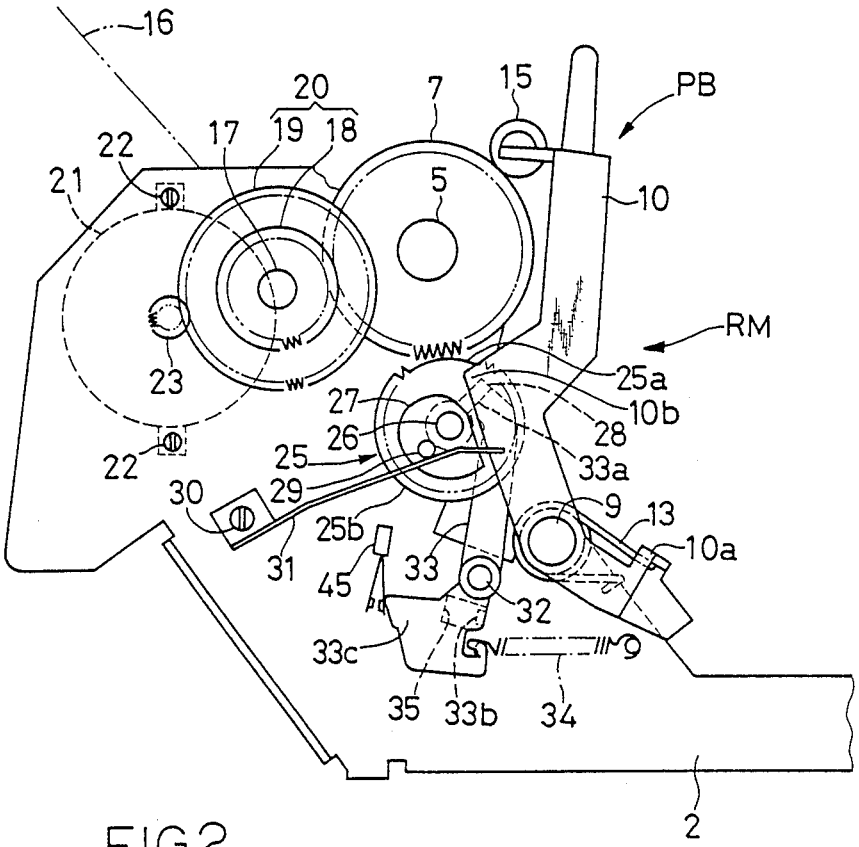
FIG. 2 is a side elevational view of the typewriter of FIG. 1.
Figure 3:
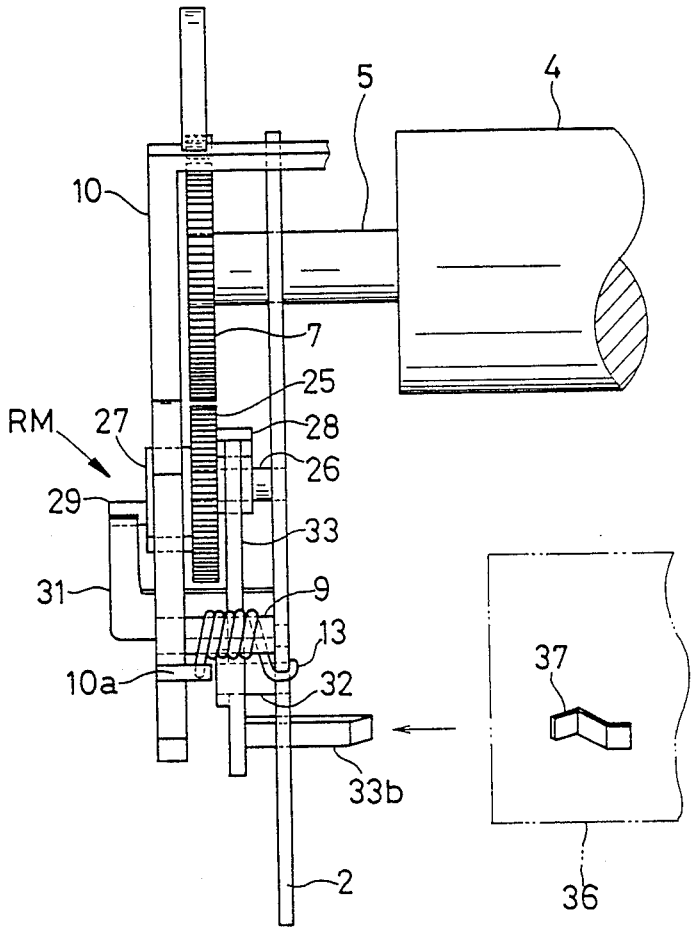
FIG. 3 is a front elevational view of a paper bail release mechanism of the paper loading apparatus.

Referring first to FIGS. 1–3, there is shown an electronic typewriter incorporating an automatic paper loading apparatus embodying the present invention. The typewriter, generally indicated at 1 in FIG. 1, has a left and a right side frame 2, 3, which are disposed at respective left and right ends within a typewriter housing. Between this pair of side frames 2, 3, there is disposed a paper support member in the form of a cylindrical platen 4 mounted on a platen shaft 5. The platen shaft 5 is rotatably supported at its opposite ends by the side frames 2, 3. The platen shaft 5 has a driven gear 7 fixed to its left end, as indicated in FIG. 2.

The typewriter 1 is equipped with a medium guide member in the form of a paper bail PB which includes a paper bail shaft 8 extending parallel to the platen 4. The paper bail shaft 8 is supported at its left end by the free end portion of a left paper bail lever 10 which is supported pivotally about a pin 9 secured to the left side frame 2. Similarly, the shaft 8 is supported at its right end by the free end portion of a right paper bail lever 12 which is supported pivotally about a pin 11 secured to the right side frame 3. A first elastic member in the form of a torsion spring 13 is wound round the pin 9, such that one end of the spring 13 engages the left paper bail lever 10, more precisely an engaging portion 10a provided at the lower end of the lever 10. The other end of the torsion spring 13 is held in engagement with the left side frame 2. Similarly, a torsion spring 14 (second elastic member) is disposed between the lower end portion of the right paper bail lever 12 and the right side frame 3. However, the torsion spring 14 has a smaller biasing force than the torsion spring 13.

The paper bail shaft 8 supported by the pivotable paper bail levers 10, 12 is movable between a first position adjacent to the surface of the platen 4, and a second position spaced away from the platen 4. Normally, the paper bail shaft 8 is kept in the first position by the torsion springs 13, 14.

The paper bail shaft 8 bears a plurality of presser rollers 15 rotatably mounted thereon such that the rollers 15 are spaced apart from each other in the longitudinal direction of the shaft 8. In the first position of the shaft 8, the presser rollers 15 urge a recording medium in the form of a cut sheet of paper 16 against the surface of the platen 4.

As shown in FIG. 2, an intermediate gear set 20 is provided behind the driven gear 7. This gear set 20 is rotatably supported by a pin 17 secured to the left side frame 2, and consists of a small gear 18 and a large gear 19 which has a larger diameter than the small gear 18. The small gear 18 is in mesh with the driven gear 7. Behind the intermediate gear set 20, there is provided a paper feeding motor 21 attached to the left side frame 2 by screws 22. The motor 21 has an output shaft having a drive gear 23 fixed thereto. The drive gear 23 is in mesh with the large gear 19 of the intermediate gear set 20.

Figure 7:
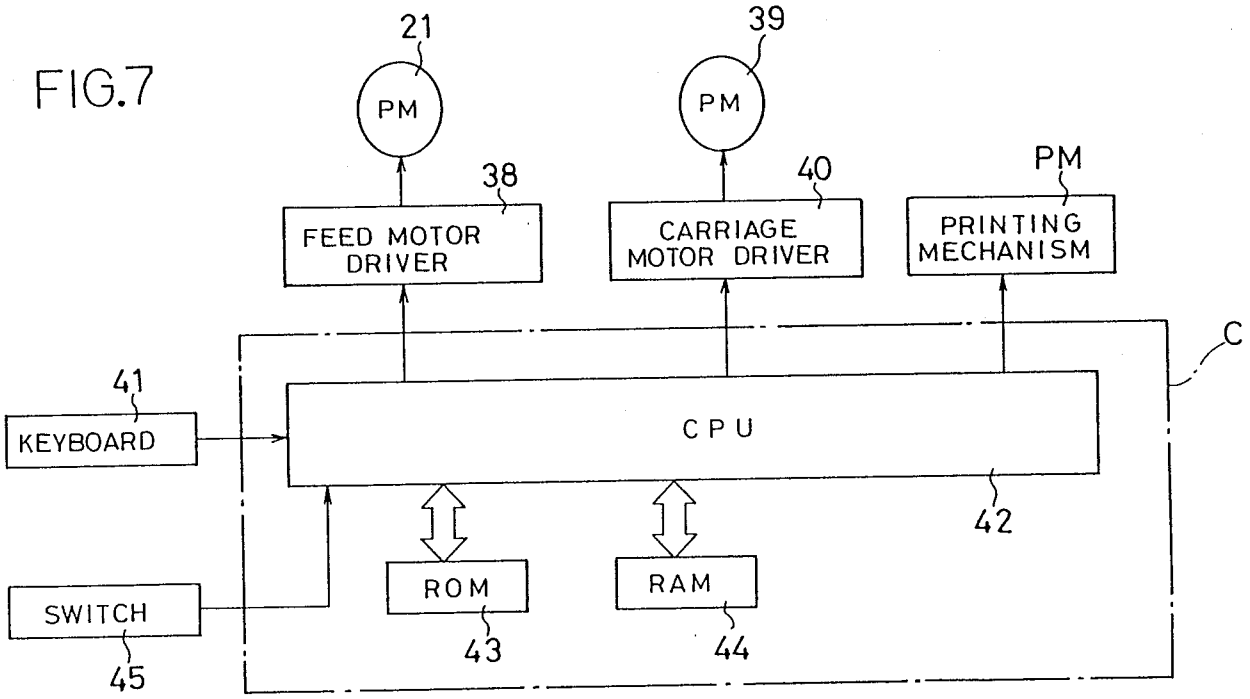
FIG. 7 is a block diagram illustrating a control system of the typewriter.

Referring to FIG. 7, there is generally indicated at C a control device which activates the paper feeding motor 21 when a CARRIAGE RETURN key or a PAPER LOADING key provided on a keyboard 41 is operated. As a result, the driven gear 7 connected to the platen 4 is rotated through the drive gear 23 and intermediate gear set 20, whereby the platen 4 is rotated by a suitable amount to feed the paper sheet 16. This paper feeding operation will be described later in detail.

When the PAPER LOADING key is operated, the cut sheet 16 is fed from a sheet feeder (not shown) and advanced onto the platen 4 such that the leading end portion of the cut sheet 16 passes between the platen 4 and the presser rollers 15 of the paper bail PB. At this time, the paper bail PB is brought to its release position, namely, the paper bail shaft 8 is moved to its second position, by a paper bail release mechanism generally indicated at RM in FIG. 3. This mechanism RM will be described.

Right below the driven gear 7, there is provided a partial gear in the form of a clutch gear 25 which is rotatably supported by a pin 26 secured to the outer surface of the left side frame 2. The clutch gear 25 has a non-toothed portion 25*a* over a suitable part of its outer circumference, and a toothed portion 25*b* over the remaining part of the circumference. The clutch gear 25 and the driven gear 7 are arranged so that the toothed portion 25*b* is engageable with the driven gear 7, which serves as a complete gear as distinguished from the partial gear 25.

A release member in the form of a release cam 27 is formed as an integral part of the clutch gear 25. That is, the release cam 27 is formed so as to extend from the left side of the clutch gear 25. The release cam 27 has a peripheral surface including a leading sloped cam portion whose radius from the center of the pin 26 increases, and a constant-radius portion over a suitable angular range. The left paper bail lever 10 has a cam foller portion 10*b* which extends toward the release cam 27. The cam follower portion 10*b* slidably contacts the sloped cam portion of the release cam 27 when the cam 27 is rotated with the clutch gear 25, whereby the paper bail lever 10 is pivotally moved toward and away from the pin 26.

As shown in FIGS. 2 and 3, a stop 28 is formed on the right side of the clutch gear 25 such that the stop 28 extends obliquely upward in the radial direction of the gear 25 at an angle of about 50° with respect to the vertical, when the clutch gear 25 is in the position of FIG. 2 in which the non-toothed portion 25*a* faces the driven gear 7.

To the left side of the release cam 27, there is secured a pin 29 such that the pin 29 is positioned away from the pin 26 and spaced apart from the stop 28 by 180° in the circumferential direction of the pin 26. A second elastic member in the form of a sheet spring 31 is fixed at its fixed end to the left side frame 2 by a screw 30, such that the free end portion of the spring 31 is held in abutting contact with the circumferential surface of the pin 29, so as to bias the clutch gear 25 in the clockwise direction (as seen in FIG. 2) that causes the toothed portion 25*b* of the clutch gear 25 to engage the driven gear 7.

Below the clutch gear 25, there is disposed a pin 32 secured to the left side frame 2. A latch member 33 is pivotally supported by the pin 32, so as to extend generally in the vertical direction. This latch member 33 has an upper end portion 33*a* bent in the rearward direction. This bent upper end portion 33*a* serves as an engaging portion which is engageable with the lower surface of the stop 28 in the position of FIG. 2, in which the stop 28 extends obliquely upward. A third elastic member in the form of a tension spring 34 is connected between a lower end portion of the latch member 33 which extends downward from the pin 32, and the left side frame 2. This tension spring 34 has a biasing force greater than that of the sheet spring 31, whereby the latch member 33 is biased in the counterclockwise direction so that the engaging portion 33*a* engages the stop 28, under the biasing action of the tension spring 34, which overcomes the biasing action of the sheet spring 31 acting on the clutch gear 25 in the clockwise direction. In the position of FIG. 2, the lower surface of the stop 28 engageable with the engaging portion 33*a* of the latch member 33 is inclined with respect to a substantially horizontal path taken by the engaging portion 33*a* when the latch member 33 is pivoted.

The latch member 33 is provided with an extension 33*b* formed integrally with its lower end portion. The extension 33*b* extends inwardly of the typewriter 1, parallel to the platen 4, through an aperture 35 formed through the left side frame 2. The counterclockwise pivotal movement of the latch member 33 by the tension spring 34 is limited by means of abutting contact of the front surface of the extension 33*b* with the corresponding inner surface of the aperture 35, as shown in FIGS. 1 and 2. This position of the latch member 33 is referred to as a "latch position" (position of FIG. 2), and the corresponding position of the clutch gear 25 (in which the non-toothed portion 25*a* faces the driven gear 7) is referred to as a "non-operated position".

The typewriter 1 has a carriage 36 with a print head 24 mounted thereon. The carriage 36 has a paper guide or paper meter 50 fixed thereto for guiding the cut sheet 16 along the platen 4, so that the sheet 16 is passed between the print head 24 and the platen 4. This paper guide 50 serves as a first paper guide member, while the paper bail PB serves as a second guide member. These first and second guide members cooperate with each other to guide the cut sheet 16 when the sheet is fed during a printing operation. The carriage 36 further has an actuator member 37 attached thereto, as indicated in FIG. 3. When the carriage 36 is moved to its leftmost position (medium loading standby position or carriage zeroing position) adjacent to the left side frame 2, the actuator member 37 is brought into abutting contact with the extension 33*b* of the latch member 33, whereby the extension 33*b* is pushed rearward toward the platen 4. As a result, the latch member 33 is pivoted in the clockwise direction (as seen in FIG. 2) to its release position of FIG. 4.

Adjacent to the latch member 33, there is provided a detector switch 45 secured to the left side frame 2. This switch 45 is adapted to detect that the carriage 36 almost reaches its leftmost position. Described more specifically, an abutting portion 33*c* of the latch member 33 is brought into contact with an operating piece of the switch 45 when the latch member 33 is pivoted clockwise (FIG. 2) to its release position of FIG. 4. At this time, an ON signal is produced by the switch 45.

Figure 4:
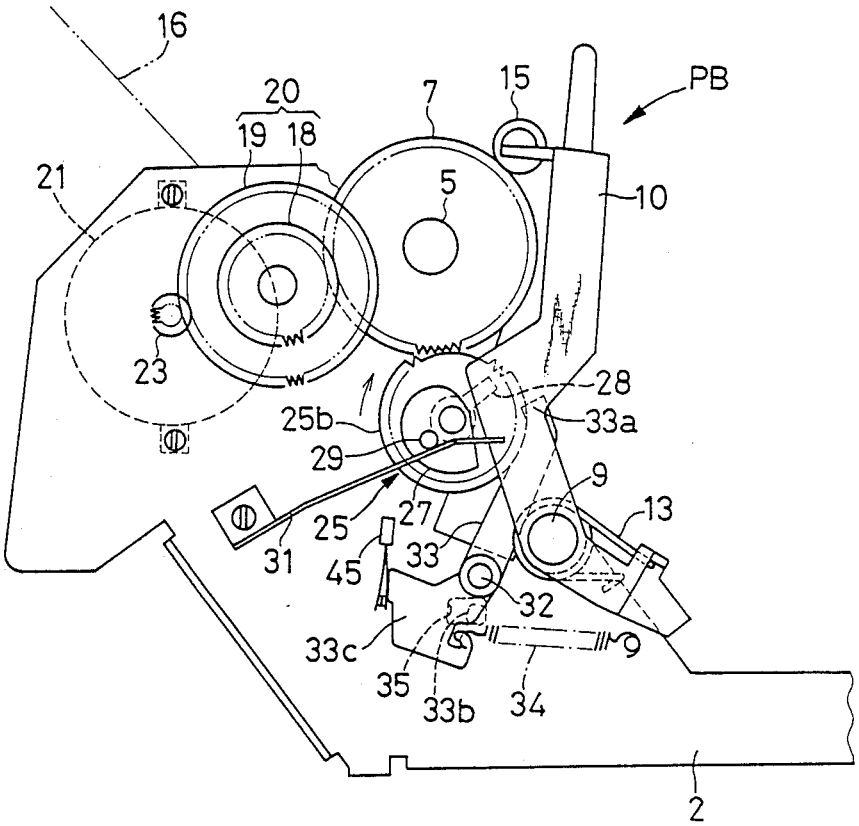
FIG. 4 is a side elevational view corresponding to that of FIG. 2, showing a state of the paper bail release mechanism in which a latch member is placed in its release position.
Figure 6:
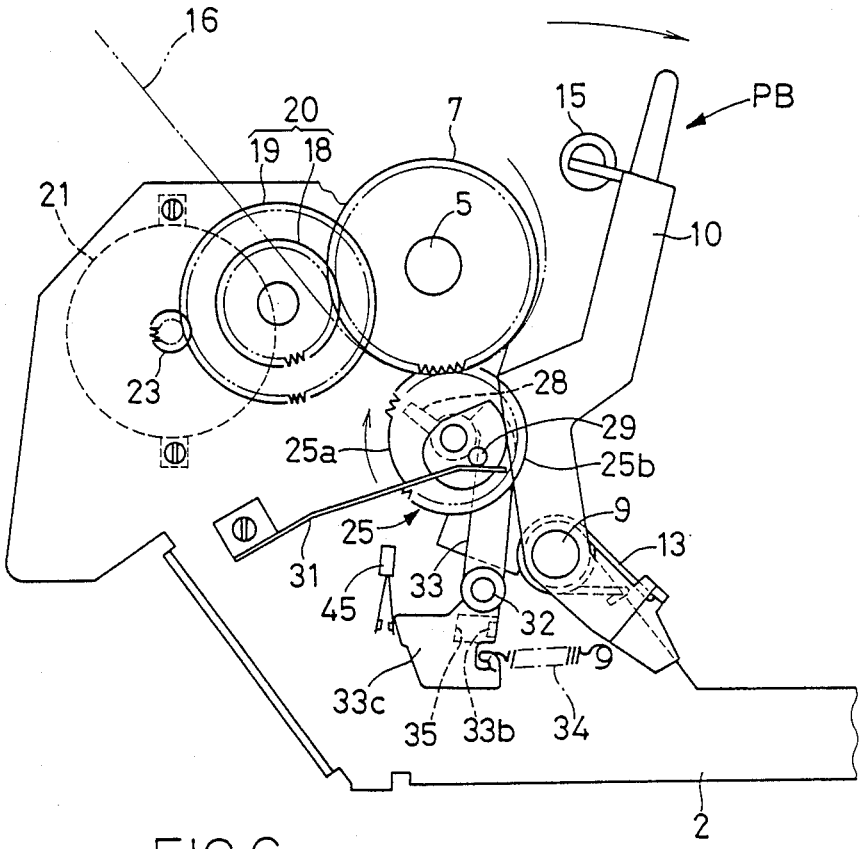
FIG. 6 is a side elevational view also corresponding to that of FIG. 2, showing a state in which a paper bail is brought to a retracted position as a result of rotation of a clutch gear.

Referring further to FIGS. 4–6 as well as FIG. 2, there will be described an operation of the paper bail release mechanism RM when the cut sheet 16 is automatically loaded.

The carriage 36 is moved to its left most position or paper loading standby position, when the PAPER LOADING key on the keyboard 41 is operated while the paper bail release mechanism RM is in the position of FIG. 2, namely while the clutch gear 25 and the latch member 33 are in the non-operated position and the latch position, respectively. As a result, the extension 33*b* of the latch member 33 is pushed rearward toward the platen 4 by the actuator member 37 attached to the carriage 36, against the biasing action of the tension spring 34, whereby the latch member 33 is pivoted to the release position of FIG. 4. Consequently, the engaging portion 33*a* of the latch member 33 is separated from the lower engaging surface of the stop 28, and the clutch gear 25 is rotated clockwise (as seen in FIG. 2) under the biasing force of the sheet spring 31, until the first tooth of the toothed portion 25*b* of the clutch gear 25 is brought into engagement with the teeth of the driven gear 7. This position of the clutch gear 25 is referred to as an "intermediate position".

When the driven gear 7 is rotated by a given angle in the paper feeding direction (counterclockwise direction as seen in FIG. 4) with the paper feeding motor 21 activated while the clutch gear 25 is in the intermediate position of FIG. 4, the clutch gear 25 is rotated by the driven gear 7 to a position of FIG. 5 at which the sloped cam portion of the release cam 27 is ready to contact the cam follower portion 10*b* of the left paper bail lever 10. This position is referred to as an "operated position" for the clutch gear 25, and as a "paper bail release start position" for the release cam 27.

When the carriage 36 is thereafter moved to the right toward the left margin position of the typewriter 1, the actuator member 37 is disengaged from the extension 33b. In this condition, the latch member 33 tends to be pivoted from the release position of FIG. 4 toward its latch position of FIG. 2, under the biasing action of the tension spring 34. However, since the rear edge of the engaging portion 33*a* of the latch member 33 is in abutment on the end face of the stop 28 as shown in FIG. 5, the latch member 33 cannot be returned to its latch position of FIG. 2. Therefore, the engaging portion 33*a* of the latch member 33 cannot engage the lower surface of the stop 28, and consequently the latch member 33 cannot prevent a clockwise motion of the clutch gear 25 (as seen in FIG. 5).

When the driven gear 7 is rotated in the paper feeding direction in the condition of FIG. 5, the clutch gear 25 is rotated clockwise to the position of FIG. 6, whereby the sloped cam portion of the release cam 27 slidably contacts the cam follower portion 10*b* of the paper bail lever 10. As a result, the paper bail shaft 8 is moved away from the platen 4 to its retracted or second position, and held in this position. In this condition, the cut sheet 16 is fed between the platen 4 and the presser rollers 15 on the paper bail shaft 8. The clutch gear 25 is rotated a suitable angle even after the last tooth of the toothed portion 25*b* is disengaged from the driven gear 7. Consequently, the clutch gear 25 is placed in its non-operated position of FIG. 2 in which the non-toothed portion 25*a* faces the driven gear 7. During this rotation of the clutch gear 25 to its non-operated position of FIG. 2, the paper bail shaft 8 is returned to its first position, while the engaging portion 33*a* of the latch member 33 is brought into engagement with the stop 28, i.e., placed in its latch position of FIG. 2.

Referring to the block diagram of FIG. 7, the control system of the electronic typewriter 1 will be described.

In FIG. 7, reference character PM designates a printing mechanism including the print head 24 which comprises a print wheel received in a wheel cassette, an indexing motor to rotate the print wheel, a driver circuit for the indexing motor, a print hammer for impacting type fonts on the print wheel, a solenoid for the print hammer, and a driver circuit for the solenoid. The printing mechanism PM further includes a ribbon cassette which accommodates a print ribbon, a ribbon feed motor for winding the print ribbon, and a driver circuit for the ribbon feed motor. Since the printing mechanism PM is similar to that used in an ordinary electronic typewriter, no further description thereof is deemed necessary to understand the principle of the invention.

The paper feeding motor 21 is connected to a feed motor driver circuit 38, and the carriage 36 is driven by a carriage drive motor 39 connected to a carriage motor driver circuit 40.

The keyboard 41, feed motor driver circuit 38, carriage motor driver circuit 40, detector switch 45 and printing mechanism PM are connected via a data bus to a CPU (central processing unit) 42 of the control device C.

The control device C further includes a ROM (read-only memory) 43 and a RAM (random-access memory) 44 which are connected to the CPU 42 via a data bus.

The ROM 43 stores control programs for controlling the driver circuits of the printing mechanism PM and the driver circuits 38, 40, and control programs for effecting an automatic paper loading operation which will be described.

The RAM 44 includes various memories for temporarily storing results of arithmetic operations performed by the CPU 42.

Figure 8:
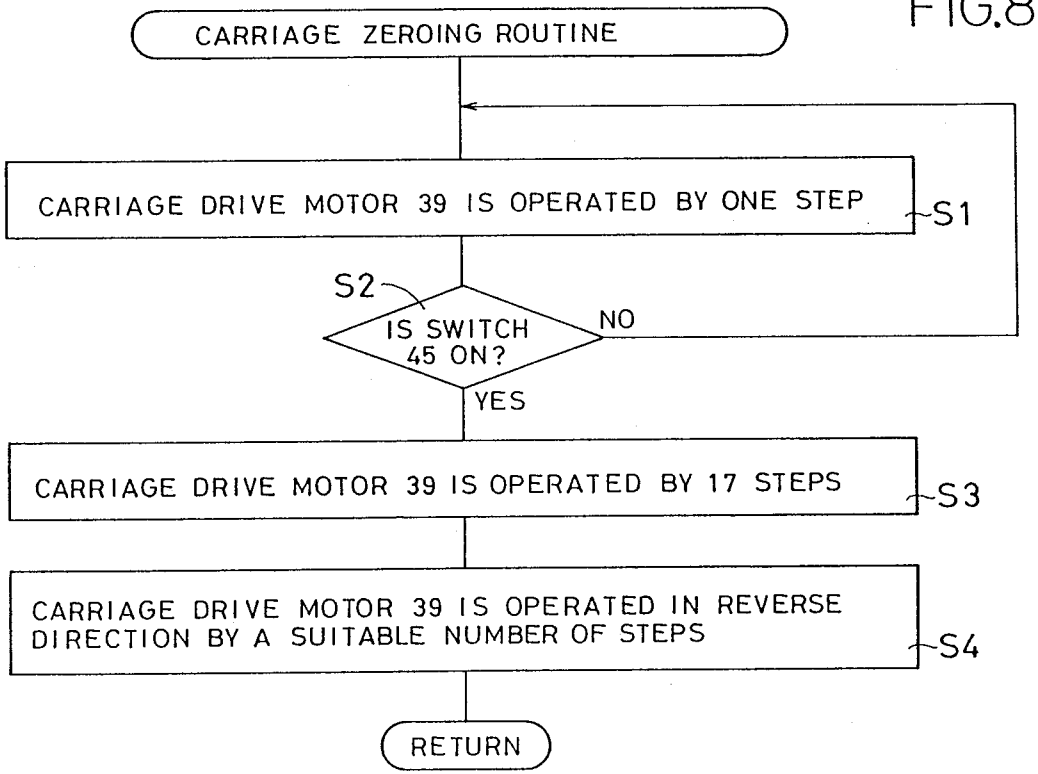
FIG. 8 is a flow chart schematically illustrating a control routine for detecting the zero point of a carriage of the typewriter.

Referring next to the flow chart of FIG. 8, there will be described an operation for establishing the zero point of the carriage 36, which occurs when the typewriter 1 is turned on, or when a top cover of the typewriter 1 covering the printing mechanism PM is opened and closed. This carriage zeroing operation is described in detail in copending U.S. patent application Ser. No. 141,590 filed on Jan. 5, 1988 (corresponding to British Patent No. 2,199,970A). In the interest of brevity, the carriage zeroing operation will be described to a minimum extent necessary to understand the principle of the invention.

Initially, the control flow goes to step S1 in which the carriage drive motor 39 is operated by one step to move the carriage 36 leftward as indicated by arrow in FIG. 3. Then, step S2 is executed to determine whether the detector switch 45 has produced an ON signal or not. Steps S1 and S2 are repeatedly executed until the ON signal is produced by the switch 45. Namely, the carriage 36 is moved leftward until the switch 45 is switched ON by the abutting portion 33*c* of the latch member 33, as a result of a pivotal movement of the latch member 33 with the extension 33*b* pushed rearward by the actuating member 37 attached to the carriage 36. In this condition wherein the carriage 36 is held in abutting contact with the left side frame 2, step S3 is executed to further operate the carriage drive motor 39 by 17 steps in the same direction. As a result, the motor 39 is energized in an out-of-synchronization manner without an angular displacement thereof. Thus, the carriage drive motor 39 and the carriage 36 are zeroed. At the same time, the latch member 33 is pivoted to the release position of FIG. 4, in which the engaging portion 33*a* is separated from the engaging surface of the stop 28, and the clutch gear 25 is placed in its intermediate position.

Then, the control flow goes to step S4 in which the carriage drive motor 39 is operated in the reverse direction to move the carriage 36 rightward to a predetermined position, such as the left margin position or print start position. As a result, the actuator member 37 attached to the carriage 36 is disengaged from the extension 33b of the latch member 33, whereby the latch member 33 is pivoted in the counterclockwise direction (FIG. 4) to the latch position of FIG. 2, under the biasing force of the tension spring 34 which is greater than that of the sheet spring 31. As the latch member 33 is pivoted to the latch position of FIG. 2, the engaging portion 33a slidably engages the stop 28, causing the clutch gear 25 to be rotated in the counterclockwise direction to the non-operated position of FIG. 2. In this connection, it is noted that the counterclockwise roration of the clutch gear 25 is facilitated by the inclination of the lower engaging surface of the stop 28 with respect to the direction of movement of the engaging portion 33a of the latch member 33.

As described above, the movement of the carriage 36 to the right away from the side frame 2 will cause the clutch gear 25 to return to the non-operated position, in which the toothed portion 25b is not in mesh with the driven gear 7. Therefore, a subsequent rotation of the driven gear 7 will not cause the paper bail release mechanism RM to be activated.

Referring to the flow chart of FIG. 9, there will be described a paper loading operation of the typewriter 1, which is controlled by the control device C.

Figure 9:
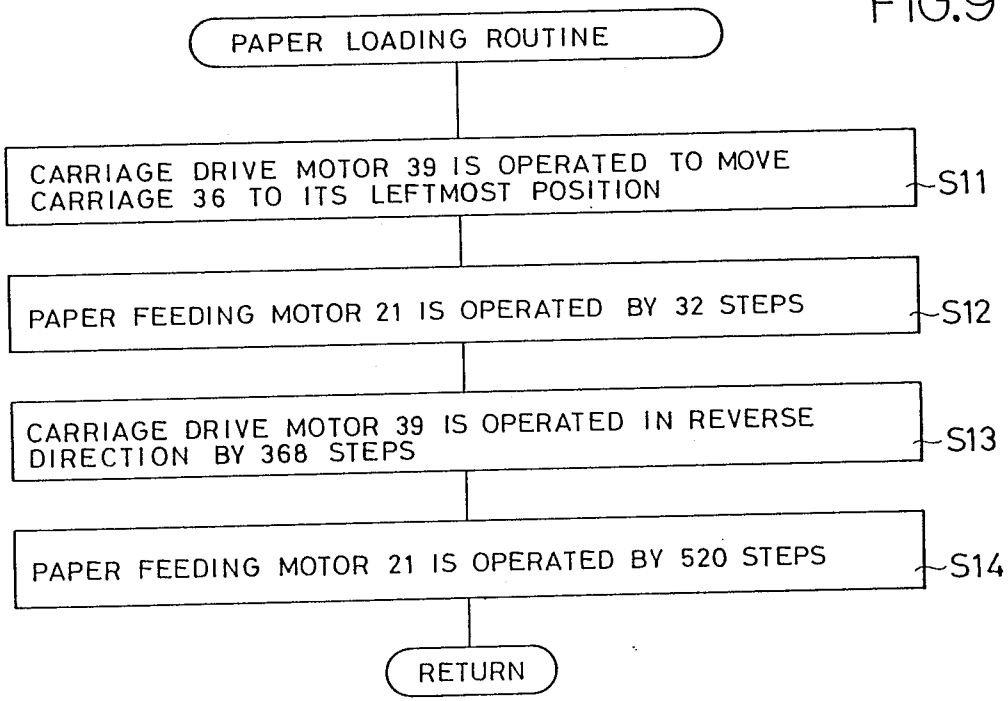
FIG. 9 is a flow chart schematically illustrating a control routine for automatically loading the typewriter with a paper sheet.

Upon operation of the PAPER LOADING key on the keyboard 41, a main control routine of the control device C is interrupted, and the paper loading routine of FIG. 9 is implemented. Initially, the control flow goes to step S11 in which the carriage drive motor 39 is operated to move the carriage 36 to its leftmost position or paper loading standby position adjacent to the left side frame 2. The number of energizing steps of the motor 39 is determined based on position data stored in a CARRIAGE POSITION memory of the RAM 44, which represents the current position of the carriage 36. As a result, the latch member 33 is pivoted to the release position of FIG. 4, and the clutch gear 25 is rotated to its intermediate position of FIG. 4. Then, the control flow goes to step S12 to operate the paper feeding motor 21 by 32 steps, whereby the clutch gear 25 is rotated to its operated position of FIG. 5.

Then, step S13 is implemented to operate the carriage drive motor 39 by 368 steps in the reverse direction, to move the carriage 36 to the right to an almost central position of the typewriter 1, that is, a paper loading position in which the typewriter is loaded with the cut sheet 16, such that the sheet 16 is guided by the paper guide 50. At this time, the latch member 33 cannot be returned to its latch position, since the rear edge of the engaging portion 33a is brought into abutting contact with the end face of the stop 28. Thus, the latch member 33 cannot prevent the clockwise rotation of the clutch gear 25 with the stop 28.

Step S13 is followed step S14 wherein the paper feeding motor 21 is operated by 520 steps. During the operation of the motor 21, the clutch gear 25 is rotated with the release cam 27 in the clockwise direction (in FIG. 5), whereby the paper bail shaft 8 is moved to its second position of FIG. 6. With the shaft 8 held in its second position, the cut sheet 16 is advanced between the platen 4 and the presser rollers 15 on the shaft 8. The motor 21 is turned off when the release cam 27 is rotated to the position of FIG. 2 in which the clutch gear 25 is placed in the non-operated position while the latch member 33 is in the latch position. After completion of this interruption routine for automatic paper loading operation, the control flow returns to the main routine.

It follows from the foregoing description that the instant embodiment permits the zeroing of the carriage 36 and the activation of the paper bail release mechanism RM to be effected at the same position, i.e., the leftmost position of the carriage 36 or paper loading standby position adjacent to the left side frame 2. Accordingly, the instant paper loading apparatus makes it possible to reduce the lateral size of the typewriter 1 and simplify the control routine for driving the carriage 36 for these purposes, as compared with the conventional paper loading apparatus which uses different positions for the above two purposes, which lead to a relatively large lateral size of the typewriter and a relatively complicated control routine for the carriage.

Further, the toothed portion 25b of the clutch gear 25 is surely brought into engagement with the driven gear 7 when the gear 7 is driven by the paper feeding motor 21 by a suitable amount after the latch member 33 is pivoted to its release position while at the same time the clutch gear 25 is rotated to its intermediate position, as a result of a movement of the carriage to the leftmost position.

While the paper bail release mechanism RM is disposed on the left side frame 2, the mechanism RM may be disposed on the right side frame 3. Further, the carriage zeroing arrangement may be modified as needed. For example, the zero point of the carriage may be established or detected simply based on a signal generated by a photoelectric sensor or a zero-point detecting switch.

Referring next to FIGS. 10–16, a modified embodiment of the paper loading apparatus of the invention will be described. In the interest of brevity and simplification, the same reference numerals as used in the preceding embodiment of FIGS. 1-9 will be used to identify the functionally corresponding elements used in the instant modified embodiment.

On the left side frame 2 to which the paper feeding motor 21 is secured, there is provided a partial gear in the form of a clutch gear 56 which is supported rotatably about a shaft 58 extending parallel to the platen 4. The clutch gear 56 has a toothed portion 62 formed on the outer circumferential surface, over an angular range of about 270°. Over the remaining angular range of the clutch gear 56, there is formed a non-toothed portion 64 which has a smaller diameter than the toothed portion 62. The toothed portion 62 is engageable with the teeth of the large gear 19 of the intermediate gear set 20. This large intermediate gear 19 serves as a complete gear, which performs the same function as the driven gear 7 in the preceding embodiment.

Figure 11:
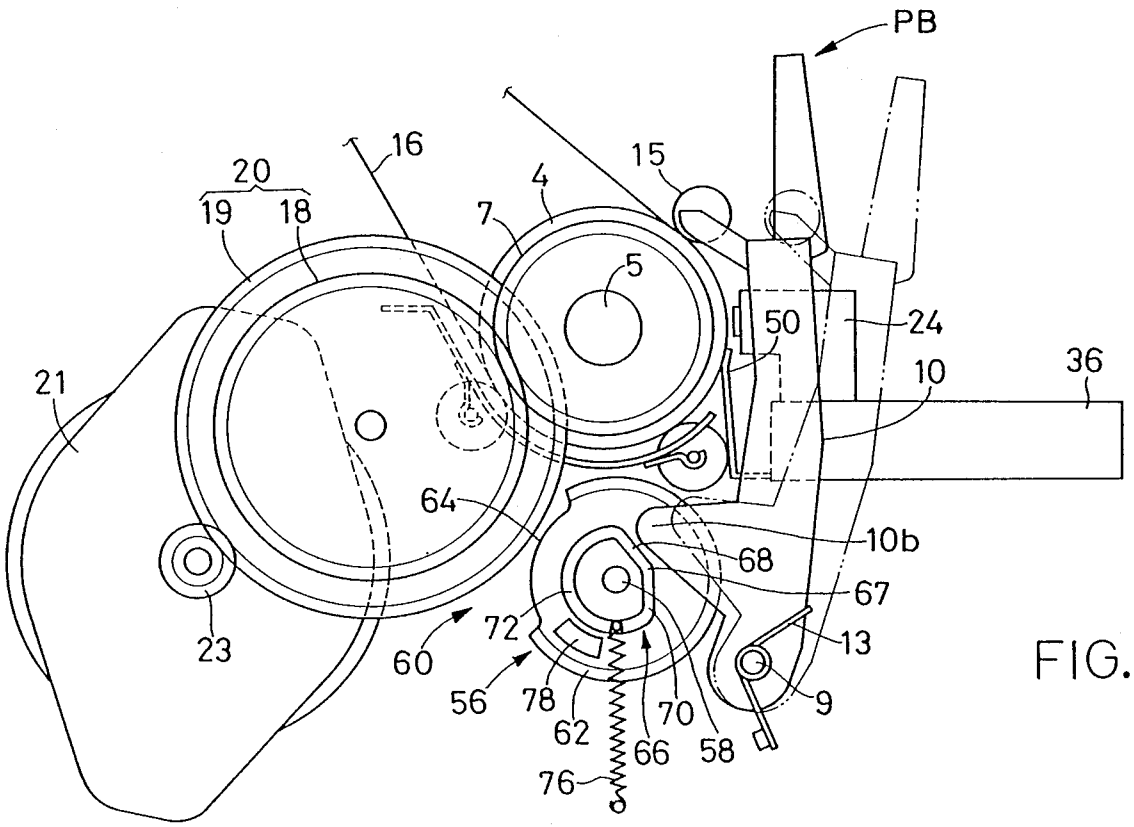
FIG. 11 is a side elevational view of the paper loading apparatus of FIG. 10.

To the outer side of the clutch gear 56, there is fixed a release member in the form of a release cam 66. When the large intermediate gear 19 is rotated by the paper feeding motor 21 in the clockwise direction (as seen in FIG. 11) while the toothed portion 62 of the clutch gear 56 is in engagement with the gear 19, the clutch gear 56 is rotated with the release cam 66 in the counterclockwise direction. The clutch gear 56 and the large intermediate gear 19 cooperate to constitute a clutch 60 which has an operated position in which the toothed portion 62 of the clutch gear 56 engages the gear 19. In this operated position of the clutch, a rotary motion of the motor 21 can be transmitted to the release cam 66. The clutch 60 also has a non-operated position in which the non-toothed portion 64 of the clutch gear 56 faces the intermediate gear 19. In this non-operated position, the motion of the motor 21 cannot be transmitted to the release cam 66.

The release cam 66 has a peripheral surface which consists of: a part-cylindrical portion 67 having a relatively small distance or radius relative to the center of the shaft 58; a pair of straight portions 68, 70 which extends from the ends of the part-cylindrical portion 67 such that the radius to the shaft 58 increases as the portions 68, 70 extend in the opposite circumferential direction of the shaft 58; and a part-cylindrical portion 72 which has a relatively large radius to the shaft 58 and which connects the pair of straight portions 68, 70.

As the release cam 66 is rotated, the trailing straight portion 70 slidably contacts the cam follower portion **10*b* of the left paper bail lever 10, thus causing the lever 10 to be pivoted in the direction that causes the presser rollers 15 to be moved away from the platen 4. The part-cylindrical portion 72 serves to maintain the presser rollers 15 (paper bail shaft 8) in thus retracted or second position. The relative position between the release cam 66 and the clutch gear 56 is determined as follows: That is, the part-cylindrical portion 67 faces the cam follower portion 10*b* of the lever 10, while the clutch 60 is placed in the non-operated position of FIG. 11. When the release cam 66 is rotated in the counterclockwise direction (FIG. 11) with the clutch 60 in the operated position, the straight portion 70 slidably engages the cam follower portion 10*b*, moving the presser rollers 15 away from the platen 4. At the end of the rotation of the cam 66, the part-cylindrical portion 72 maintains the presser rollers 15 (shaft 8) in the second position. Further, the straight portion 68 serves to return the presser rollers 15 (shaft 8) to the operated or first position for contact with the platen 4. When the clutch 60 is restored to its non-operated position, the part-cylindrical portion 67 is again brought into facing relation with the cam follower portion 10*b* of the lever 10**.

The clutch gear 56 is held in its original position of FIG. 11 by a tension coil spring 76 which is connected to the part-cylindrical portion 72 and the side frame 2. In this original position, the relatively trailing part of the non-toothed portion 64 of the clutch gear 56 as viewed in its rotating direction (counterclockwise direction in FIG. 11) faces the large intermediate gear 19, while the part-cylindrical portion 67 of the release cam 66 faces the cam follower portion **10*b* of the lever 10, permitting the presser rollers 15 in the first position. While the clutch gear 56 is placed in its original position, the tension coil spring 76 does not exert any biasing force on the clutch gear 56 in the clockwise or counterclockwise directions. When the clutch gear 56 is rotated from the original position upon activation of the paper feeding motor 21, the spring 76 is elongated and functions to return the clutch gear 56 to the original position. The clutch gear 56 has an arcuate elongate hole 78 formed through its thickness, along an arc of a circle having a center on the axis of the shaft 58**.

Figure 10:
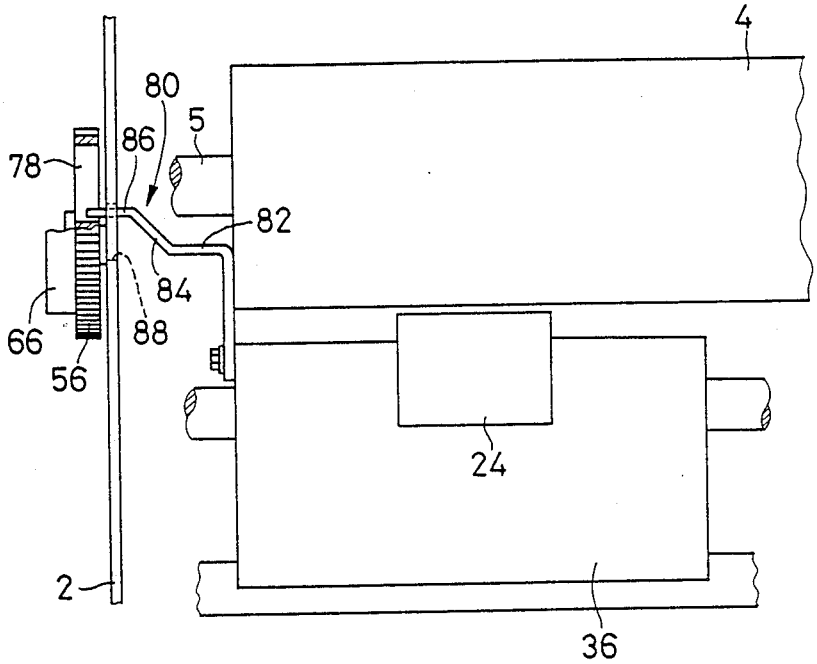
FIG. 10 is a fragmentary plan view of a typewriter equipped with another embodiment of an automatic paper loading apparatus of the invention, depicting a paper bail release mechanism which includes a clutch gear, and a sheet spring attached to the typewriter's carriage.

To the side surface of the carriage 36 which faces the left side frame 2, there is fixed a sheet spring 80 in a cantilever fashion, as shown in FIG. 10. This sheet spring 80 has a base portion 82 having a partial parallel to the direction of movement of the carriage 36, an inclined portion 84 extending obliquely from the end of the base portion 82, and a distal portion 86 extending from the end of the inclined portion parallel to the above-indicated part of the base portion 82. The sheet spring 80 is positioned on the carriage 36 such that the distal portion 86 is spaced a small distance from the leading end of the elongate hole 78 (as viewed in the direction of rotation of the clutch gear 56) in the direction opposite to the direction of rotation of the gear 56, as indicated in FIG. 10, when the clutch gear 56 is placed in its original position of FIG. 11.

Figure 12:
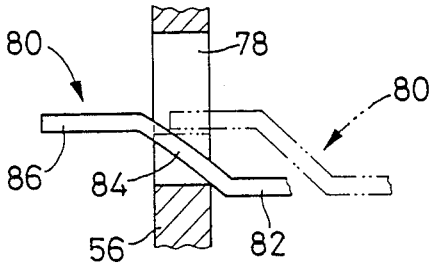
FIG. 12 is a plan view in cross section showing a state in which the sheet spring is inserted through an elongate hole formed in the clutch gear.

When the carriage 36 is moved toward the left side frame 2, the distal portion 86 of the sheet spring 80 is passed through an aperture 88 formed through the side frame 2, and inserted through the elongate hole 78, as indicated in two-dot chain line in FIG. 12. As the carriage 36 is further moved, the inclined portion 84 of the sheet spring 80 is brought into engagement with the inner surface defining the leading end of the hole 78, as indicated in solid line in FIG. 12. With the inclined portion 84 slidably engaging the hole 78, the clutch gear 56 is rotated in the counterclockwise direction as viewed in FIG. 11, as the carriage 36 is moved. As a result, the leading tooth of the toothed portion 62 of the clutch gear 56 is brought into abutment on a tooth of the large intermediate gear 19. When the carriage 36 is further moved by a small distance, the sheet spring 80 is elastically deflected permitting the clutch gear 56 to remain at rest. Thus, the clutch gear 56 is biased by the sheet spring 80 so that the leading tooth of the toothed portion 62 is held in pressed contact with the appropriate tooth of the gear 19. However, the thus contacting teeth of the gears 56, 19 may be disengaged from each other when the biasing force of the sheet spring 80 is removed.

When the biasing force of the sheet spring 80 is removed from the clutch gear 56 with the sheet spring 80 disengaged from the elongate hole 78 as a result of movement of the carriage 36 away from the left side frame 2, the leading tooth of the clutch gear 56 is separated from the appropriate tooth of the gear 19, and the clutch gear 56 is rotated in the clockwise direction as viewed in FIG. 11, under the biasing action of the coil spring 76. Thus, the clutch 60 is returned to the non-operated position. The position of the clutch 60 in which the teeth of the gears 19, 56 are held in pressed abutting contact with each other as a result of movement of the carriage 36 toward the side frame 2 is referred to as an "intermediate position". In the present embodiment, the elongate hole 78 and the sheet spring 80 constitute a switching device for switching the clutch 60 from the non-operated position to the intermediate position. When the typewriter is loaded with the cut sheet 16, the carriage 36 is moved to the paper loading standby position indicated at A in FIG. 13, to move the sheet spring 80 to the position indicated in solid line in FIG. 12, so that the clutch 60 is switched to the operated position. In the present embodiment, too, the zeroing of the carriage 36 upon power application to the typewriter is effected at the paper loading standby position A.

Figure 14:
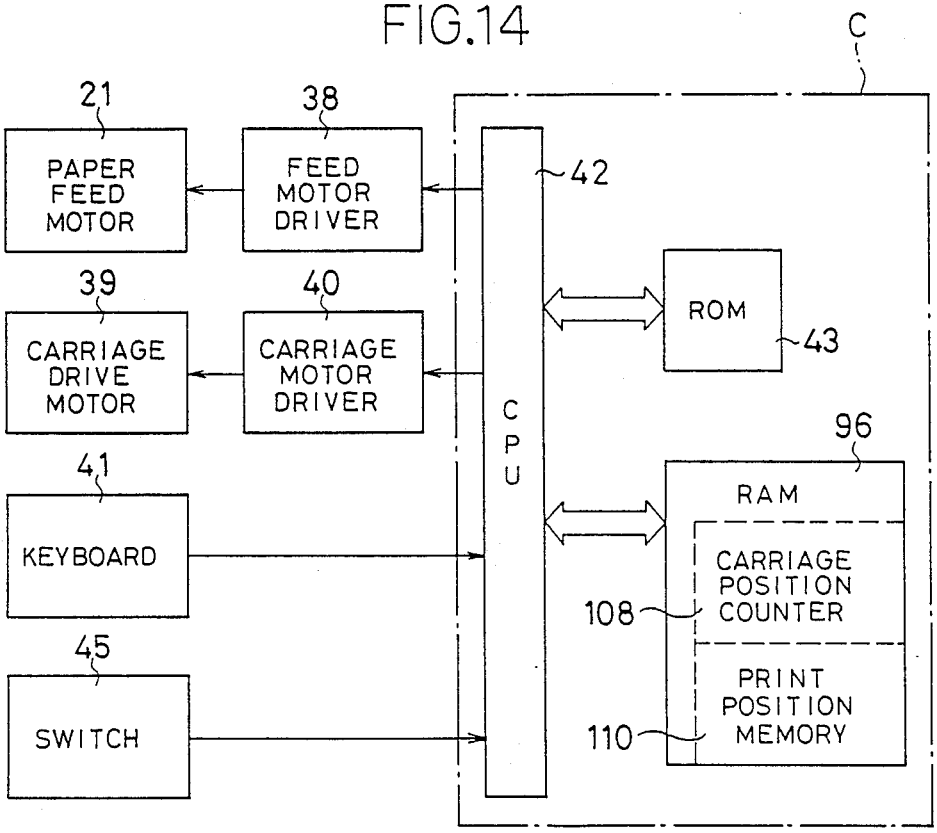
FIG. 14 is a block diagram showing a control system of the typewriter of FIG. 10.
Figure 15:
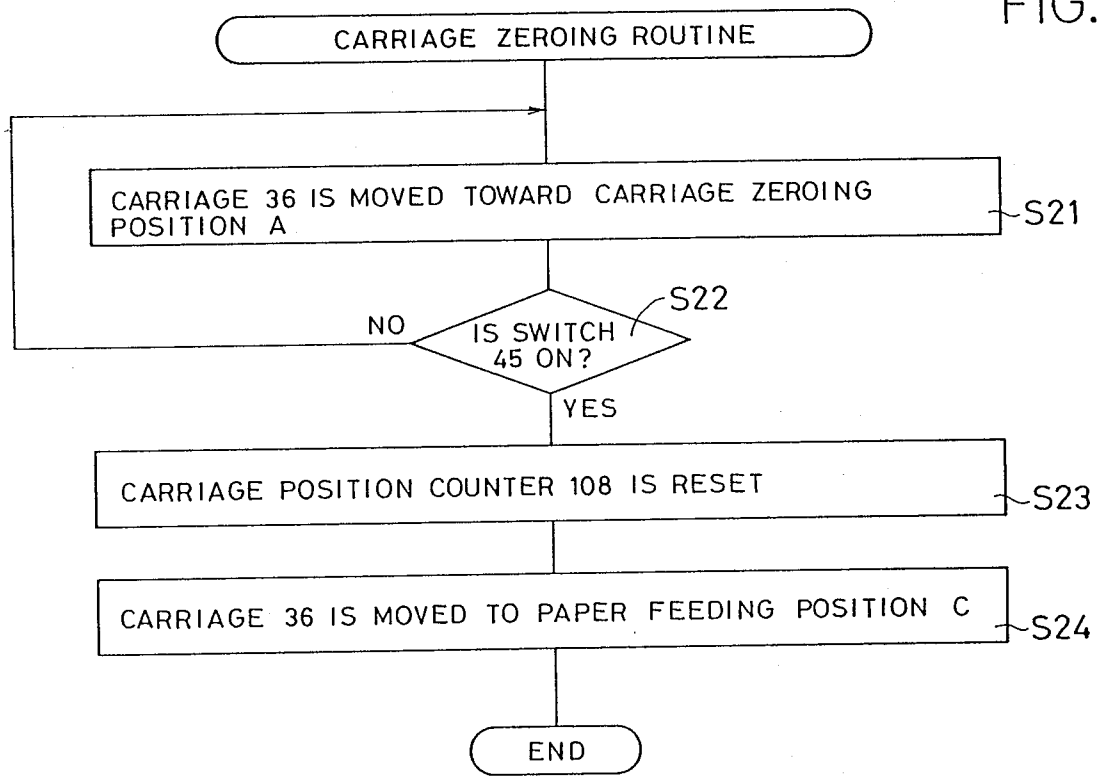
FIGS. 15 and 16 are flow charts illustrating those of control programs stored in a ROM of a computer of the control system, which are associated with the principle of the present invention.

The instant typewriter is controlled by the control device C shown in FIG. 14. The control device C incorporates a RAM 96 which has a CARRIAGE POSITION counter 108 and a PRINT POSITION memory 110. The CARRIAGE POSITION counter 108 stores position data indicative of the current position of the carriage 36. Namely, the content of the counter 108 is incremented or decremented as the carriage 36 is moved along the platen 4. The PRINT POSITION memory 110 stores data indicative of predetermined positions of the carriage 36 such as the left and right margin positions which are entered through the keyboard 41. The ROM 43 stores the control programs for executing the carriage zeroing routine of FIG. 15 and the paper loading routine of FIG. 16. According to these control programs, the control device C implements the operation to establish the zero point of the carriage 36 as one of the initialization steps, and the operation to automatically load the typewriter with the cut sheet 16. These operations will be described, by reference to FIGS. 15 and 16.

Figure 13:
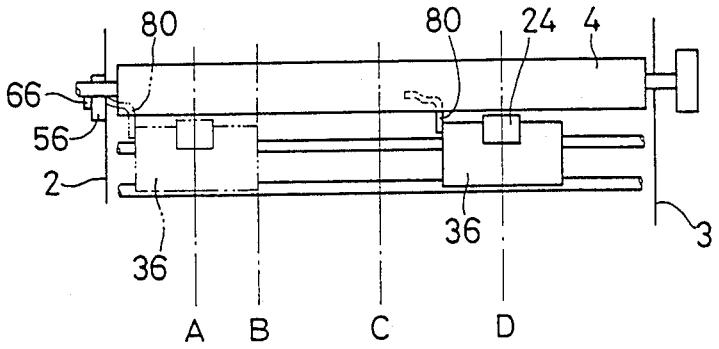
FIG. 13 is a plan view schematically illustrating positions of the carriage.

Upon application of power to the typewriter, the control flow goes to step S21 wherein the carriage drive motor 39 is operated to move the carriage 36 to the carriage zeroing position (paper loading standby position) A as indicated in FIG. 13. Then, the control flow goes to step S22 to determine whether the detector switch 45 is ON or not. The switch 45 is turned ON when the carriage 36 reaches the carriage zeroing position A, and an affirmative decision (YES) is obtained in step S22. Consequently, step S22 is followed by step S23 in which the carriage drive motor 39 is turned off, and the CARRIAGE POSITION counter 108 is reset to zero. Then, the control flow goes to step S24 in which the carriage 36 is moved to a paper loading position C (also indicated in FIG. 13) which is in the middle of the printing area of the typewriter. This position C is obtained from the left and right margin positions entered by the operator through the keyboard 41.

Figure 16:
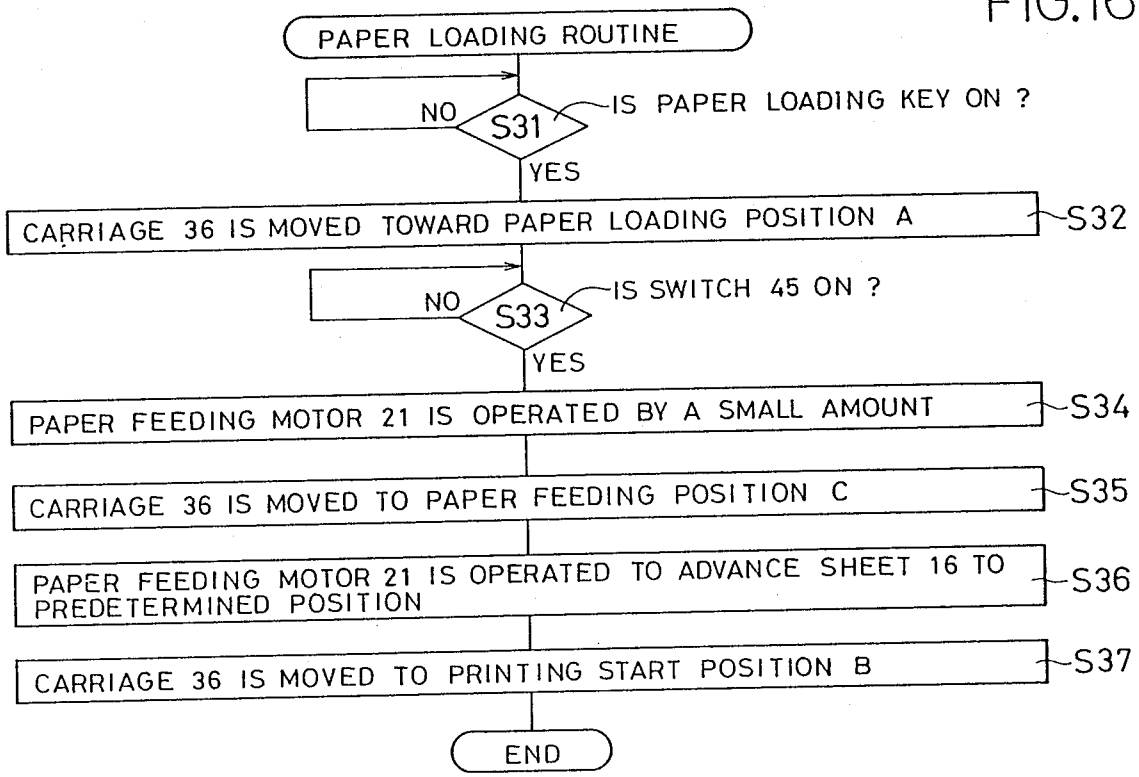

When the PAPER LOADING key on the keyboard 41 is operated after the carriage 36 is zeroed as described above, an affirmative decision (YES) is obtained in step S31 of the paper loading routine of FIG. 16. Consequently, the control flow goes to step S32 in which the carriage drive motor 39 is operated to move the carriage 36 toward the paper loading standby position A (leftmost or carriage zeroing position). When the carriage 36 reaches the paper loading standby position A, the detector switch 45 is turned ON, whereby an affirmative decision (YES) is obtained in step S33. At the same time, the movement of the carriage 36 to the paper loading standby position A causes the clutch gear 56 to be rotated by the sheet spring 80, whereby the clutch 60 is brought to its intermediate position.

Then, the control flow goes to step S34 wherein the paper feeding motor 21 is operated by a small amount, to rotate the clutch gear 56 by a small angle whereby the toothed portion 62 of the clutch gear 56 sufficiently engages the large intermediate gear 19. Thus, the clutch 60 is placed in its operated position in which the rotary motion of the motor 21 can be transmitted to the release cam 66. Then, the control flow goes to step S35 in which the carriage 36 carrying the paper guide 50 is moved to the paper loading position C in the middle of the printing area. Step S35 is followed by step S36 in which the paper feeding motor 21 is operated by an amount necessary to advance the cut sheet 16 to the predetermined position. Thus, the cut sheet 16 is delivered from a suitable paper stacker, and advanced with the rotation of the platen 4. While the sheet 16 is fed toward the platen 4, the clutch gear 56 is rotated by the gear 19, whereby the paper bail lever 10 is pivoted by the release cam 66, and the presser rollers 15 are moved away from the platen 4, so that the leading end of the cut sheet 16 can pass between the platen 4 and the lifted presser rollers 15, while being guided by the paper guide 50. Thus, the cut sheet 16 can be advanced until the leading edge reaches the predetermined printing start position, which is spaced a suitable distance away from the nips between the rollers 15 (in the first or lowered position) and the platen 4, in the rotating direction of the platen 4. When the leading edge of the sheet 16 reaches the predetermined printing start position, the toothed portion 62 of the clutch gear 56 is disengaged from the gear 19, and the clutch gear 56 is returned to the original or non-operated position of FIG. 11 under the biasing action of the tension coil spring 76. Concurrently, the lever 10 of the paper bail PB is pivoted under the biasing action of the spring 13, so that the paper bail shaft 8 is returned to the first position in which the presser rollers 15 are held in pressed contact with the surface of the platen 4. Then, the control flow goes to step S37 in which the carriage drive motor 39 is operated to move the carriage 36 to the printing start position B indicated in FIG. 13. Thus, the typewriter is set ready for starting a printing operation on the cut sheet 16.

As described above, the paper loading apparatus incorporated in the instant typewriter is adapted such that the mere movement of the carriage 36 to the paper loading standby position A (carriage zeroing position) will not cause the clutch 60 to be placed in its operated position. Therefore, the carriage 36 can be moved to the paper loading or carriage zeroing position a, even when the operator does not intend to load the typewriter with the cut sheet 16. Further, the same position A can be used for effecting both the carriage zeroing operation and the paper loading operation. Accordingly, the instant typewriter has a relatively wide printing area, without increasing its lateral size in the direction of the movement of the carriage.

Moreover, the same control program may be used for the paper loading operation and the carriage zeroing operation, with respect to the carriage movement, because the same position A is used for these two different operations. Thus, the control system for the typewriter is relatively simple.

Furthermore, the switching device for controlling the clutch 60 is simply made up of the elongate hole 78 and the sheet spring 80. This simple construction of the switching device contributes to reduced cost of manufacture of the typewriter.

It follows from the above description that the portions of the control device C assigned to execute steps S31–S37, detector switch 45, paper feed driver circuit 38 and carriage motor driver circuit 40 constitute a major portion of a control device for controlling the paper loading apparatus according to the principle of the present invention.

While the above-illustrated two embodiments use a medium support member in the form of the rotatably supported cylindrical platen 4 which functions as a part of the paper feeding mechanism, the medium support member may be a stationary elongate member designed for merely supporting the recording medium. In this case, it is desirable that the friction coefficient of the stationary platen be as small as possible, and the paper feeding mechanism employs suitable paper feeding rolls.

In the illustrated embodiments, the platen 4 functions as a support member for supporting the recording medium not only at its portion facing the print head 24, but also at the other portions. However, these other portions may be supported by a separate medium support member. In this instance, the platen may be a stationary member, and the separate medium support member may be a rotatably supported roll which cooperates with the presser rollers 15 of the paper bail PB to advance the recording medium. Alternatively, the platen may be a rotatably supported member while the separate medium support member may be a stationary member.

It will be understood that the present invention may be embodied with various other changes, modifications and improvements, which may occur to those skilled in the art.

What is claimed is:

1. An apparatus for automatically loading a printer with a recording medium, comprising:

a support member supported by a frame of the printer, for supporting the recording medium;

a medium feeding mechanism having a medium feeding motor, for feeding the recording medium;

a carriage having a print head mounted thereon and movable in a longitudinal direction of said support member, said carriage having a medium loading standby position;

a medium guide member having a presser portion and pivotally supported by said frame such that said medium guide member is movable between a first position in which said presser portion urges the recording medium against said support member, and a second position in which said presser portion is spaced apart from said support member;

holding means for holding said medium guide member in said first position;

a release member actuated by said medium feeding motor, for pivoting said medium guide member to said second position;

a clutch operable between an operated position for transmitting a motion of said medium feeding motor to said release member, a non-operated position in which said motion is not transmitted to said release member, and an intermediate position between said non-operated and operated positions;

a switching device operable by a movement of said carriage to said medium loading standby position, for operating said clutch from said non-operated position to said intermediate position in which a movement of said carriage away from said medium loading standby position toward a printing area of the printer permits said clutch to return to said non-operated position unless said medium feeding motor is activated; and a control device for controlling an operation to load the printer with the recording medium, by moving said carriage to said medium loading standby position, and activating said medium feeding motor so as to operate said clutch from said intermediate position to said operated position.

2. An apparatus according to claim 1, wherein said clutch comprises a partial gear which has a non-toothed portion and a toothed portion, and a complete gear which has teeth on an entire circumference thereof and which is engageable with said partial gear, a rotary motion of said complete gear being prevented from being transmitted to said partial gear while said non-toothed portion of said partial gear faces the teeth of said complete gear, and being permitted to be transmitted to said partial gear while said toothed portion of the partial gear engages the teeth of said complete gear.

3. An apparatus according to claim 2, wherein said switching device comprises:

a first elastic member for biasing said partial gear in one rotating direction;

a stop which is rotated with said partial gear;

a latch member including an engaging portion engageable with said stop, and operable to hold said clutch in said non-operated position in which said partial gear is maintained against a biasing force of said first elastic member, in a position in which said non-toothed portion faces said complete gear;

a second elastic member for biasing said latch member in a direction that causes said engaging portion to engage said stop;

a latch release mechanism disposed between said latch member and said carriage, for moving said latch member away from said stop as said carriage is moved toward said medium loading standby position;

said stop being inclined with respect to a direction of movement of said engaging portion of said latch member while said clutch is in said intermediate position in which a tooth of said partial gear which defines one end of said non-toothed portion is in engagement with one of said teeth of said complete gear under the biasing action of said first elastic member; and a biasing force of said second elastic member being determined to be sufficient to rotate said partial gear against the biasing force of said first elastic member, in a direction that causes said tooth at said one end of said non-toothed portion to be disengaged from said one tooth of said complete gear, with said engaging portion of said latch member held in sliding contact with said stop, through an effect of a relative inclination between said stop and said direction of movement of said engaging portion.

4. An apparatus according to claim 3, further comprising a sensor disposed adjacent to said latch member, for detecting a separation of said latch member from said stop.

5. An apparatus according to claim 2, wherein said support member comprises a platen rotatably supported by said frame, and a gear train through which said platen is driven by said medium feeding motor, said platen serving as a major element of said medium feeding mechanism, while said complete gear serving as one member of said gear train.

6. An apparatus according to claim 2, wherein said switching device comprises a first elastic member for biasing said partial gear toward a position thereof in which said non-toothed portion faces said complete gear, a second elastic member extending from said carriage, and engaging means engageable with said second elastic member and rotatable with said partial gear, a shape of said second elastic member being determined such that said second elastic member is brought into engagement with said engaging means as said carriage is moved toward said medium loading standby position, and is elastically deformed by said engaging means as said carriage is further moved, whereby said engaging means is biased in a direction that causes said partial gear to be rotated against a biasing force of said first elastic member, and said clutch is maintained in said intermediate position by said second elastic member.

7. An apparatus according to claim 6, wherein said engaging means consists of a portion of said partial gear which defines a hole formed through a thickness thereof, said second elastic member consists of a sheet spring which is inserted in said hole and engages said portion of said partial gear defining said hole.

8. An apparatus according to claim 2, wherein said control device operates said medium feeding motor by an amount sufficient to cause said clutch to be moved to said operated position in which said toothed portion of said partial gear engages said complete gear after said carriage is moved to said medium loading standby position, said control device then operates said carriage away from said medium loading standby position, and operating said medium feeding motor by an amount necessary to feed said recording medium to a predetermined print start position.

9. An apparatus according to claim 1, wherein said medium guide member comprises:

a paper bail shaft extending parallel to said support member;

a pair of levers having fixed end portions at which the levers are pivotally supported by said frame, and free end portions at which the levers support opposite ends of said paper bail shaft; and a plurality of presser rollers rotatably supported on said paper bail shaft and spaced apart from each other in an axial direction of said paper bail shaft.

10. An apparatus according to claim 1, wherein said holding means comprises at least one elastic member for biasing said medium guide member toward said first position.

11. An apparatus according to claim 1, wherein said release member consists of a cam which rotates with said partial gear and which is engageable with a cam follower portion of said medium guide member to pivot said medium guide member to said second position thereof.

12. An apparatus for automatically loading a printer with a recording medium, comprising:

a support member supported by a frame of the printer, for supporting the recording medium;

a medium feeding mechanism having a medium feeding motor, for feeding the recording medium;

a carriage having a print head and a first medium guide member mounted thereon and movable in a longitudinal direction of said support member, said carriage having a medium loading standby position;

a second medium guide member having a presser portion and pivotally supported by said frame such that said second medium guide member is movable between a first position in which said presser portion urges the recording medium against said support member, and a second position in which said presser portion is spaced apart from said support member;

holding means for holding said second medium guide member in said first position;

a release member actuated by said medium feeding motor, for pivoting said second medium guide member to said second position;

a clutch operable between an operated position for transmitting a motion of said medium feeding motor to said release member, a non-operated position in which said motion is not transmitted to said release member, and an intermediate position between said non-operated and operated positions;

a switching device operable by a movement of said carriage to said medium loading standby position, for operating said clutch from said non-operated position to said intermediate position in which a movement of said carriage away from said medium loading standby position to a medium medium loading position permits said clutch to return to said non-operated position unless said medium feeding motor is activated; and a control device for controlling an operation to load the printer with the recording medium, by moving said carriage to said medium loading standby position, activating said medium feeding motor by an amount sufficient to cause said clutch to be moved to said operated position, moving said carriage from said medium loading standby position to said medium loading position, and then activating said medium feeding motor by an amount necessary to feed said recording medium to a predetermined print start position such that said medium is passed between said support member and said second medium guide member, while being guided by said first medium guide member.

* * * * *